US006926580B1

(12) United States Patent
Wang

(10) Patent No.: US 6,926,580 B1
(45) Date of Patent: Aug. 9, 2005

(54) ROBOTIC TOY

(75) Inventor: Sheng-Chien Wang, Taichung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/020,166

(22) Filed: Dec. 27, 2004

Related U.S. Application Data

(60) Provisional application No. 60/614,481, filed on Oct. 1, 2004.

(51) Int. Cl.[7] ..... A63H 3/28

(52) U.S. Cl. ..... 446/299; 446/300; 446/302; 446/322; 446/353

(58) Field of Search ..... 446/298–303, 446/322, 330, 352, 353, 397

(56) References Cited

U.S. PATENT DOCUMENTS 2,953,869 A * 9/1960 Collischan ..... 446/191
3,060,631 A * 10/1962 Collischan ..... 446/301
3,131,497 A * 5/1964 Wathel ..... 40/457
3,199,248 A * 8/1965 Suzuki ..... 446/299
3,469,039 A * 9/1969 Lee ..... 360/8
4,389,811 A * 6/1983 Iwaya et al. ..... 446/193
4,571,208 A * 2/1986 Saigo et al. ..... 446/353
4,913,676 A * 4/1990 Koguchi et al. ..... 446/300
5,316,516 A * 5/1994 Saitoh ..... 446/175
6,135,846 A * 10/2000 Young ..... 446/302

FOREIGN PATENT DOCUMENTS

GB 2230468 A * 10/1990 ..... A63H 13/02

* cited by examiner

*Primary Examiner*—Bena Miller
(74) *Attorney, Agent, or Firm*—Bacon & Thomas PLLC

(57) ABSTRACT

A robotic toy has a pedestal, a first casing assembly, a first transmission device, a mounting shaft assembly and a toy assembly. The pedestal has a speaker and a battery container. The first casing assembly is trunk-like and is mounted on the pedestal. The first transmission device and the mounting shaft assembly are mounted in-to the first casing assembly and cooperate with each other to provide a rotating function. The toy assembly is mounted rotatably on the mounting shaft assembly and has movable wings. The bird-like toy assembly can flap its wings, shake its toy head and open its lower beak and coordinate with the speaker producing music or bird song to perform in a natural and charming manner.

6 Claims, 8 Drawing Sheets

ROBOTIC TOY

CROSS REFERENCE TO RELATED APPLICATIONS

This application claims the benefit of U.S. Provisional Application No. 60/614,481, filed on Oct. 01, 2004.

BACKGROUND OF THE INVENTION

1. Field of the Invention

The present invention relates to a robotic toy, and more particularly to a robotic toy with a toy assembly rotating on a branch, wherein the toy assembly has flapping wings, a shaking head and an opening and closing mouth.

2. Description of Related Art

Various robotic toys have been disclosed and appeared in the market. Conventional robotic toys are driven by electricity and move to attract and please people especially children. However, the motion of the toys is usually monotonous and now hardly attracts consumers.

To overcome the shortcomings, the present invention provides a robotic toy to mitigate or obviate the aforementioned problems.

SUMMARY OF THE INVENTION

The main objective of the invention is to provide a robotic toy that has a bird-like toy assembly rotating on a branch-like means. The bird-like toy assembly can flap its wings in a vivacious, shake its head and open a lower beak and coordinate with a speaker producing music or bird song. The robotic toy in accordance with the present invention performs in a natural and charming manner.

A robotic toy in accordance with the present invention has a pedestal, a first casing assembly, a first transmission device, a mounting shaft assembly and a toy assembly.

The pedestal has a speaker and a battery container. The first casing assembly is trunk-like and is mounted on the pedestal. The first transmission device and the mounting shaft assembly are mounted into the first casing assembly and cooperate with each other to provide a rotating function. The toy assembly is mounted rotatably on the mounting shaft assembly and has movable wings.

Other objectives, advantages and novel features of the invention will become more apparent from the following detailed description when taken in conjunction with the accompanying drawings.

DETAILED DESCRIPTION OF PREFERRED EMBODIMENT

Figure 1:
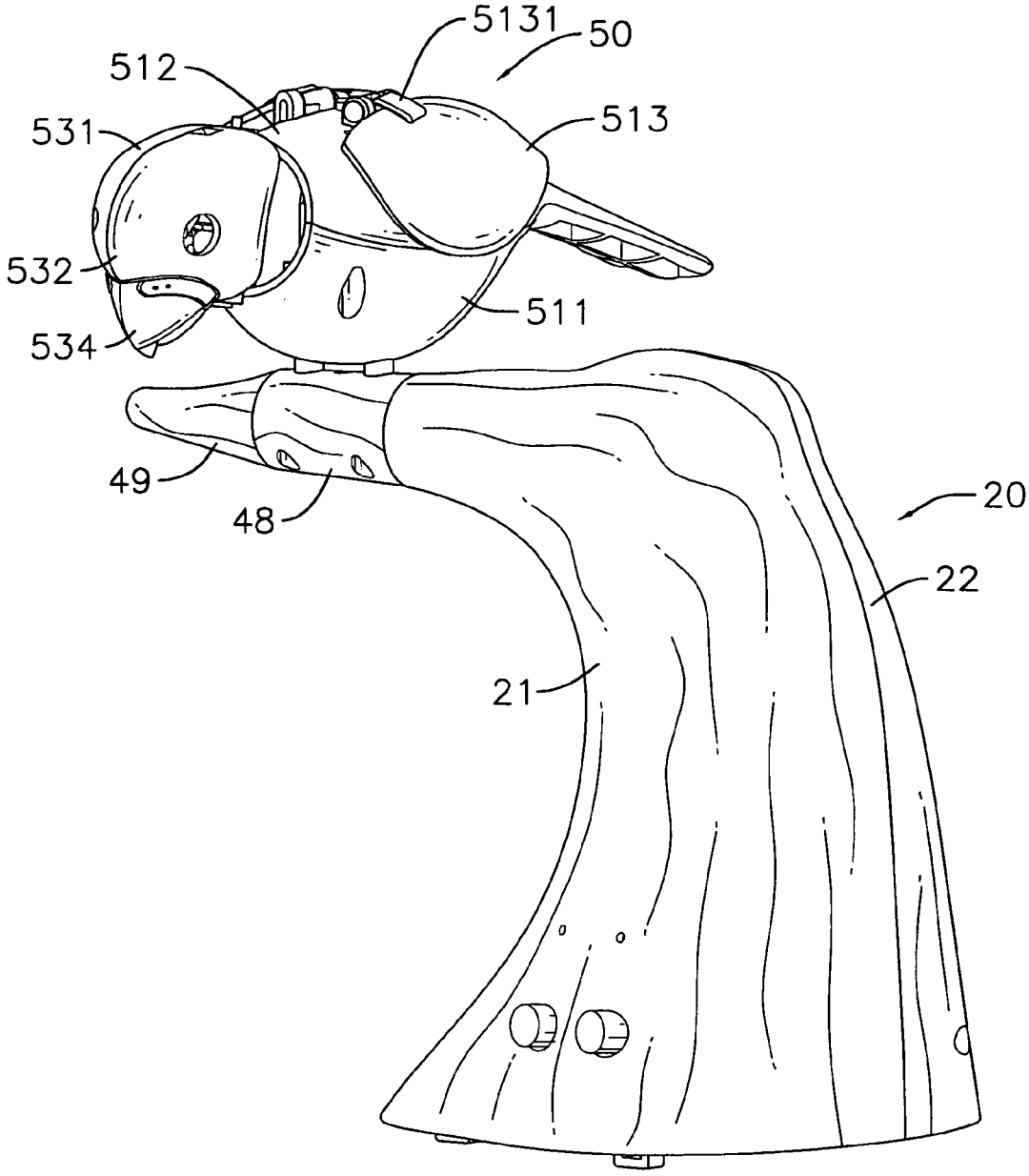
FIG. 1 is a perspective view of a robotic toy in accordance with the present invention.
Figure 2:
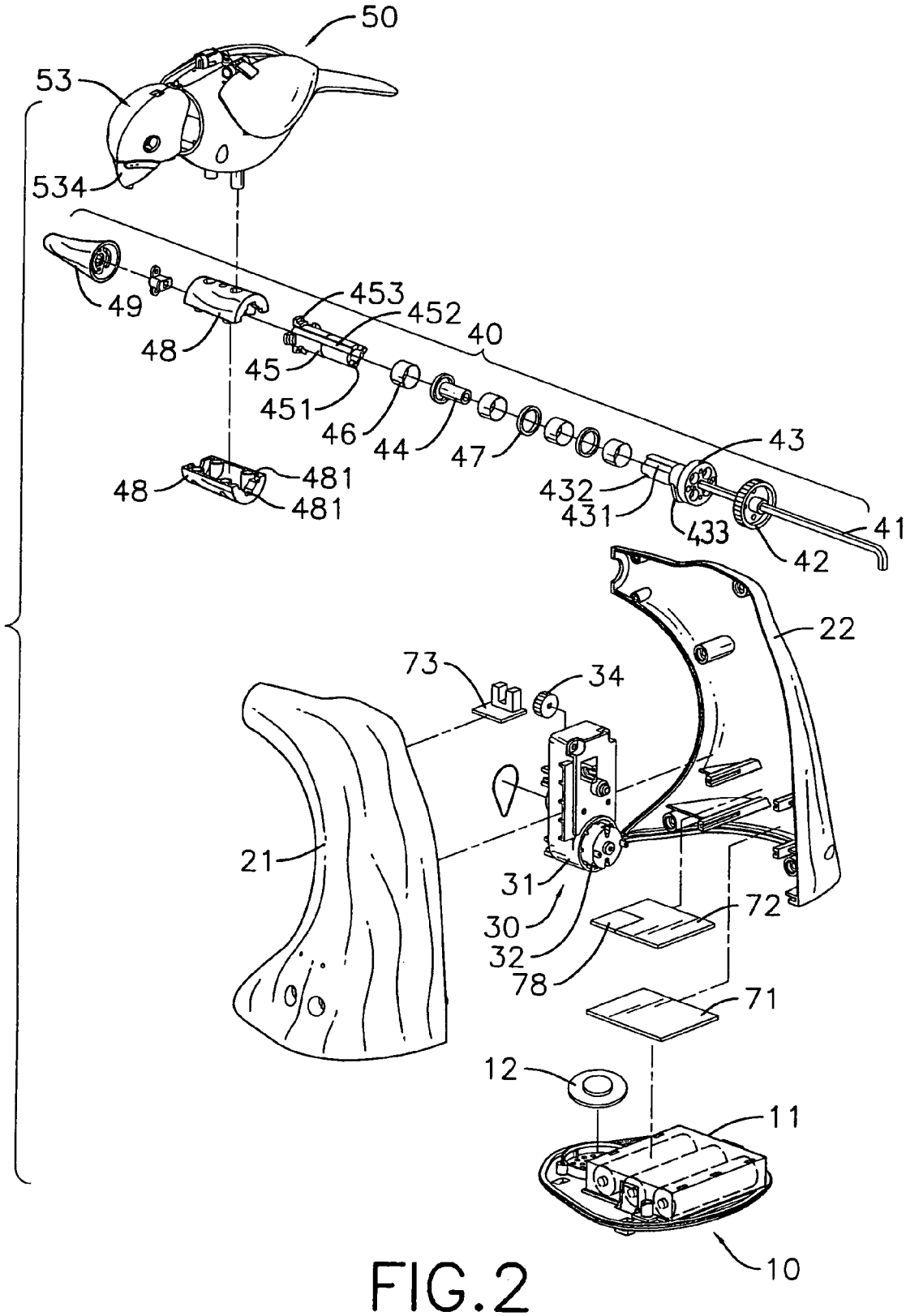
FIG. 2 is an exploded perspective view of the robotic toy in FIG. 1.

With reference to FIGS. 1 and 2, a robotic toy in accordance with the present invention has a pedestal (10), a first casing assembly (20), a first transmission device (30), a mounting shaft (41) assembly (40), a toy assembly (50) and a control device.

The pedestal (10) has a top, a bottom, a battery container (11) and a speaker (12). The battery container (11) is formed on the pedestal (10) and has multiple battery sockets defined in the bottom of the pedestal (10). The speaker (12) is mounted on the top of the pedestal (10).

The first casing assembly (20) is tree-like or trunk-like, is mounted on the top of the pedestal (10) and has a front casing (21), a back casing (22) and a branch portion. The front casing (21) is mounted on the pedestal (10) and has an inner surface. The back casing (22) is mounted on the front casing (22) and has an inner surface. The branch portion is formed with the combination of the front and back casings (21, 22) and has a left open end.

Figure 3:
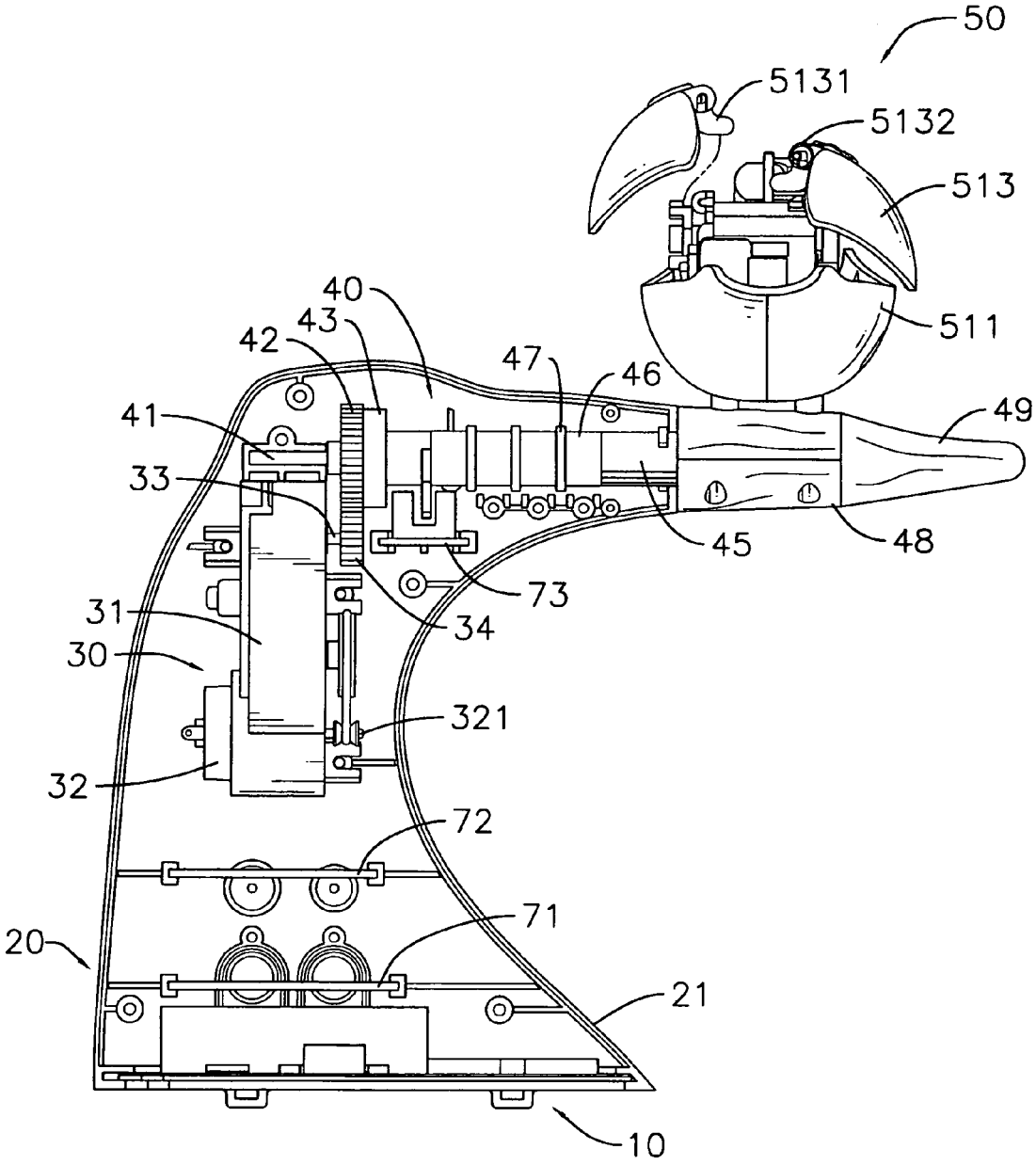
FIG. 3 is an exploded back view in partial cross section of the robotic toy in FIG. 1.

With further reference to FIG. 3, the first transmission device (30) is mounted in the first casing assembly (20) and has a hollow device body (31), a transmission motor (32), a shaft (33) and a driving gear (34). The hollow device body (31) is mounted on the inner surface of the front casing (21) and has a left side and a right side. The transmission motor (32) is embedded into the right side of the device body (31) and has a left end, a right end and a spindle (321). The spindle (321) is rotatably mounted on the left end of the transmission motor (32) through the left side of the device body (31). The shaft (33) is mounted through the left side of the device body (31), and rotates in response to the transmission motor (32) by belt means or gear means provided to the device body (31) and has an outside end. The driving gear (34) is mounted securely on the outside end of the shaft (33).

The mounting shaft assembly (40) is mounted inside the first casing assembly (20) and has a mounting shaft (41), a driven gear (42), a driving sleeve (43), a connecting cylinder (44), a connecting sleeve (45), four bushings (46), three isolating washers (47), a branch segment (48), and a tip (49).

The mounting shaft (41) is mounted securely inside the first casing assembly (20), extends through the left open end of the branch portion of the first casing assembly (20) and has a left end, a non-circular cross-section and an axis.

The driven gear (42) is mounted rotatably around the mounting shaft (41), engages with the driving gear (34) and has a left side and a central tunnel. The central tunnel is defined through the driven gear (42) and allows the mounting shaft (41) to extend through the central tunnel.

The driving sleeve (43) is mounted securely on the left side of the driven gear (42) and has an outer surface, a right mounting portion, a left open end, multiple first wire grooves (431), a central hole, a side tab and at least one recess (432). The right mounting portion is securely mounted on the left side of the driven gear (42). The first wire grooves (431) are defined on the outer surface of the driving sleeve (43) along the axis of the mounting shaft (41) and are arranged at intervals. The central hole of the driving sleeve (43) is defined through the driving sleeve (43) and allows the right mounting portion to extend rotatably through the central hole. The side tab (433) is formed transversely on the outer surface of the driving sleeve (43). The at least one recess (432) is defined in the left open end of the driving sleeve (43).

The connecting cylinder (44) extends through the left open end into the central hole of the driving sleeve (43) and has a central passage, a left open end and a right open end. The central passage of the connecting cylinder (44) is defined through the connecting cylinder (44) and allows the mounting shaft (41) to extend through the central passage.

The connecting sleeve (45) is mounted in the left open end of the driving sleeve (43) around the connecting cylinder (44) and has an outer surface, a central bore, a right open end, at least one protrusion (451), multiple second wire grooves (452) and multiple mounting tabs (453). The central bore is defined through the connecting sleeve (45), allows the mounting shaft (41) to extend through the central bore and allows the left open end of the connecting cylinder (44) to extend into the central bore. The at least one protrusion (451) is formed on the right open end of the connecting sleeve (45) and corresponds to the at least one recess (432) of the driving sleeve (43). The second wire grooves (452) are defined in the outer surface of the connecting sleeve (45) and along the axis of the mounting shaft (41). The second wire grooves (452) are further arranged at intervals and correspond to the first wire grooves (431) on the driving sleeve (43). The multiple mounting tabs (453) are formed on the outer surface adjacent to the left open end of the connecting sleeve (45) and are located respectively between the adjacent second wire grooves (452) on the connecting sleeve (45).

The bushings (46) are made of metal and mounted on the outer surfaces of the driving sleeve (43) and the connecting sleeve (45) and each bushing (46) an inner surface and an outer surface.

The isolating washers (47) are made of plastic or other isolating material, are mounted rotatably on the surfaces of the driving sleeve (43) and connecting sleeve (45) and are located respectively between adjacent bushings (46).

The branch segment (48) is mounted securely on the left open end of the connecting sleeve (45) and has a central orifice, an inner surface, a right open end, a left open end and multiple transverse recesses (481). The central orifice is defined through the branch segment (48) and allows the mounting shaft (41) to extend through the central orifice. The transverse recesses (481) are defined in the inner surface adjacent to the right open end of the branch segment (48) and correspond to the mounting tabs (453) of the connecting sleeve (45).

The tip (49) is mounted securely on the left end of the mounting shaft (41) and adjacent to the left open end of the branch segment (48).

Figure 5:
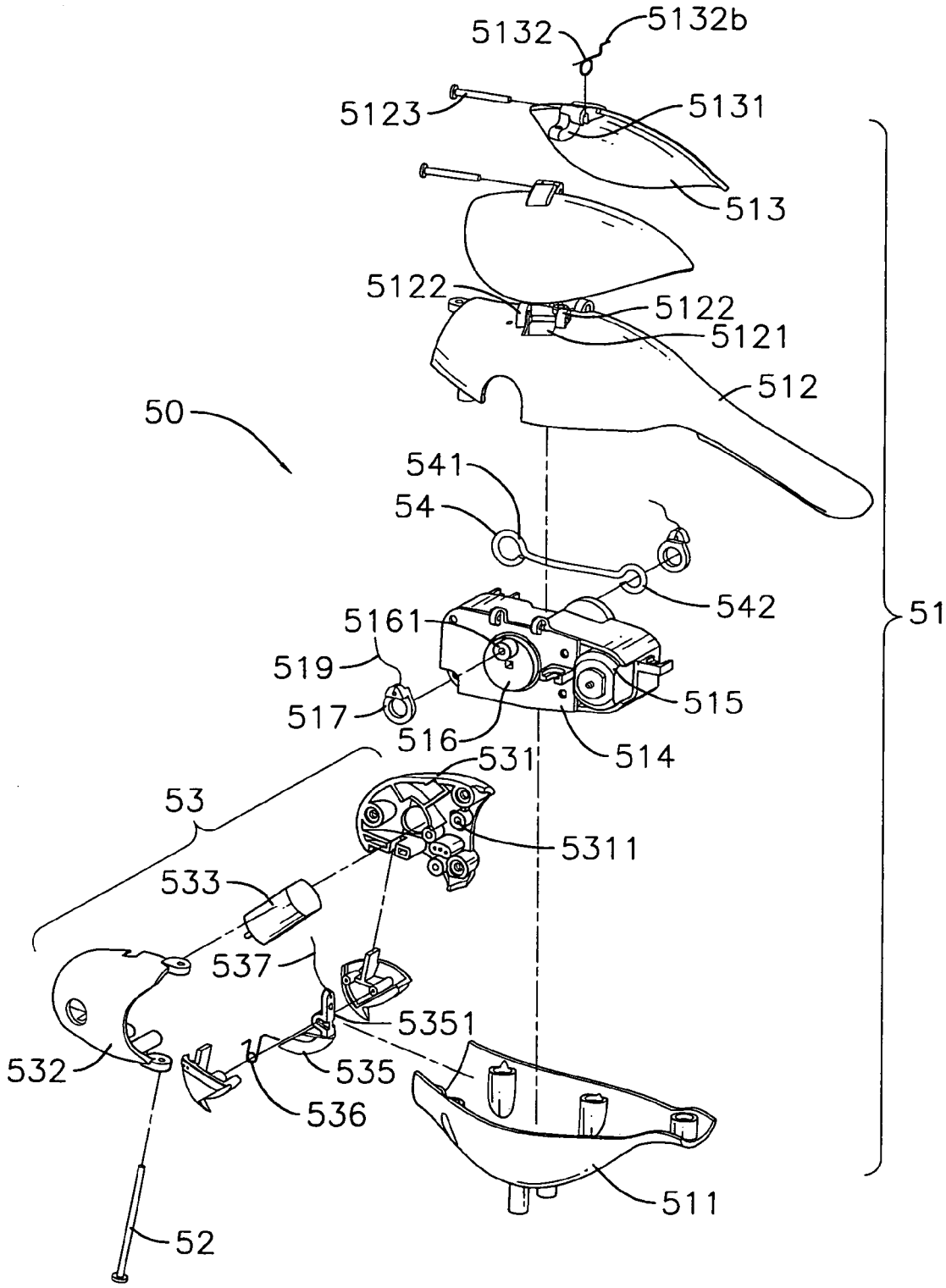
FIG. 5 is an exploded perspective view of the toy assembly of a first embodiment of the robotic toy in FIG. 1.
Figure 6:
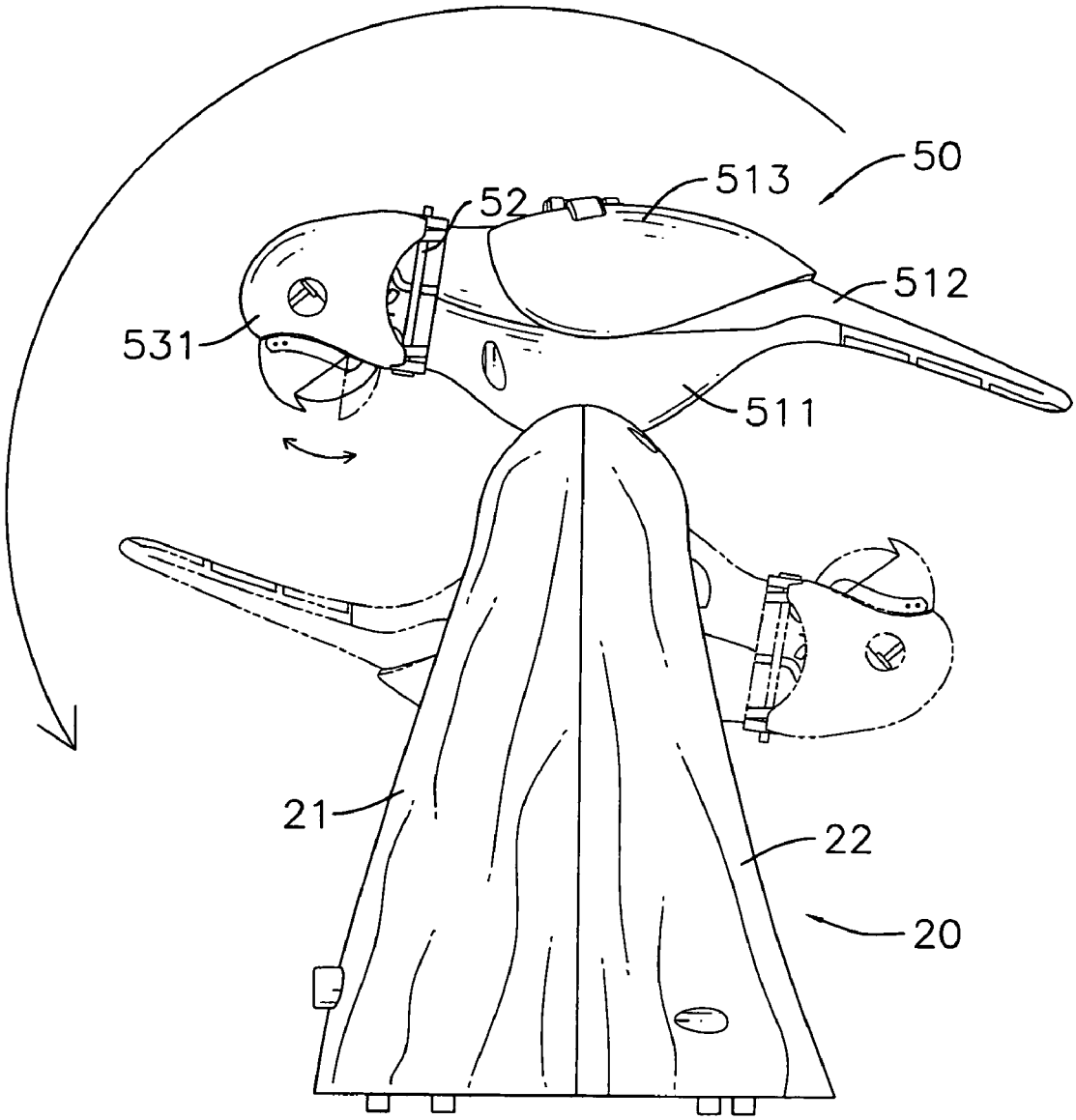
FIG. 6 is an operational view of the robotic toy in FIG. 1 showing that the toy assembly pivots on the mounting shaft assembly and the mouth opens.
Figure 7:
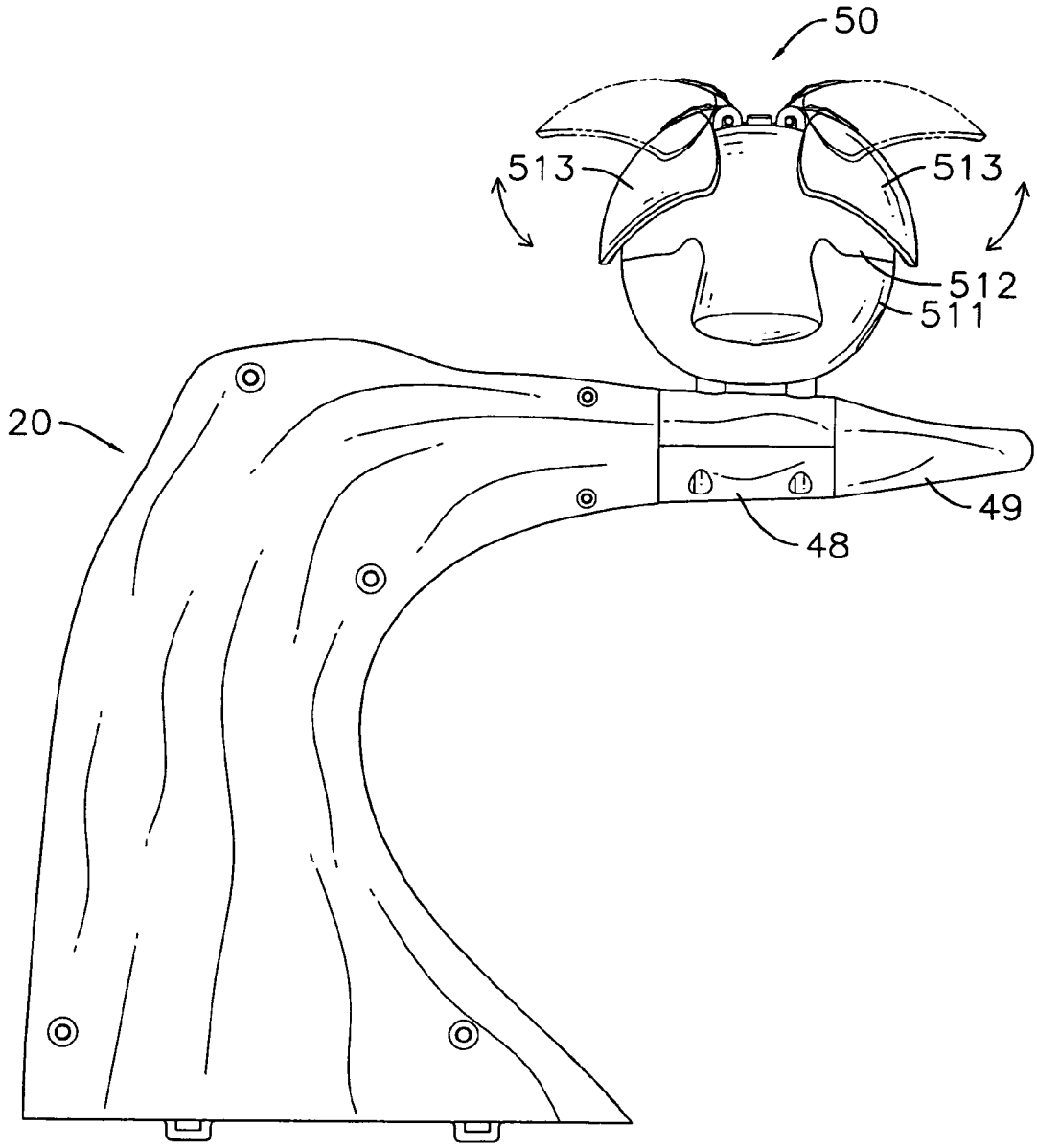
FIG. 7 is an operational view of the robotic toy in FIG. 1 showing that the wings of the toy assembly flap.
Figure 8:
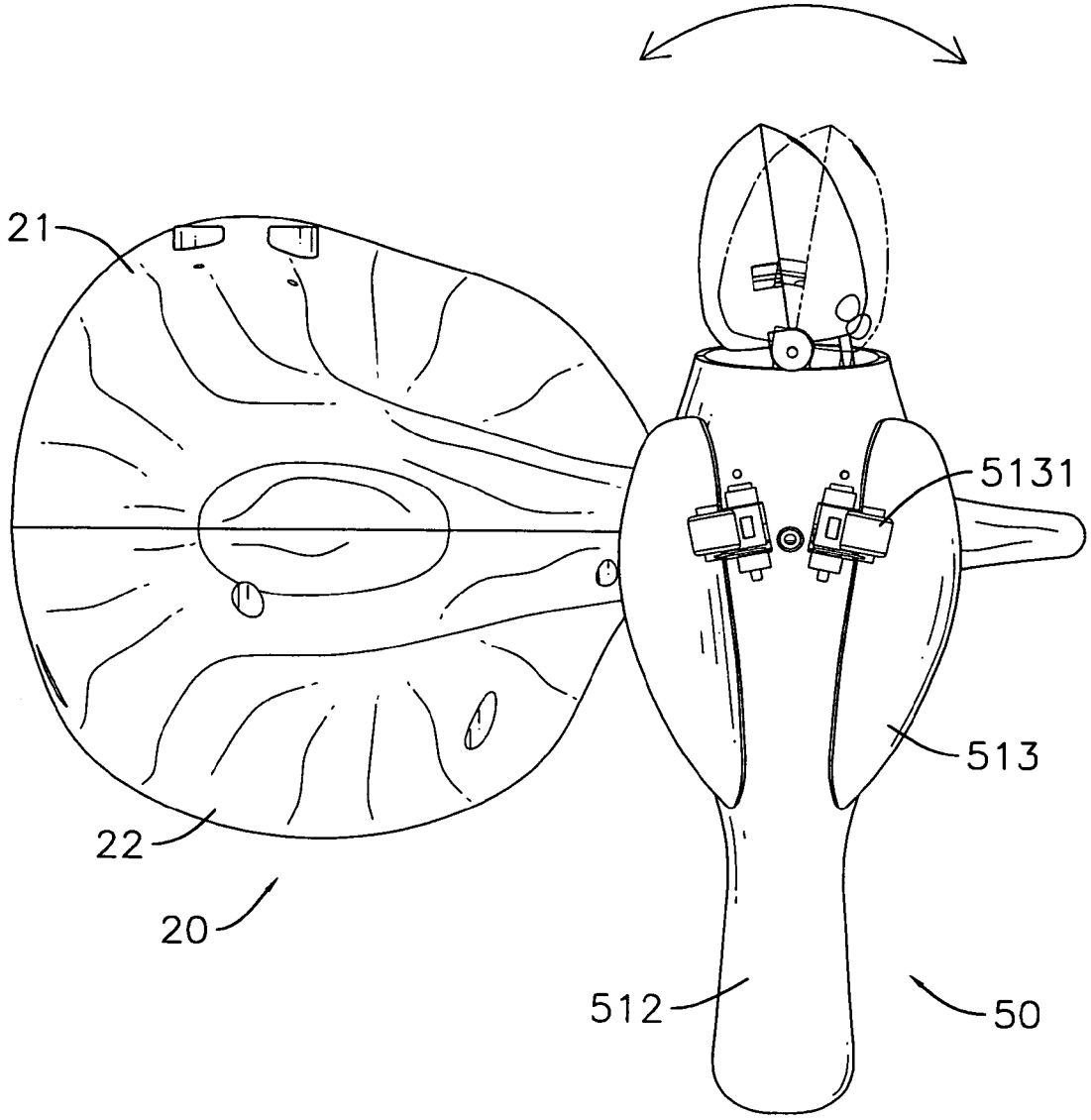
FIG. 8 is an operational top view of the robotic toy in FIG. 1 showing that the head of the toy assembly shakes to the left and right.

With reference to FIG. 5, the toy assembly (50) is mounted rotatably on the mounting shaft assembly (40) and has a toy body (51), a head-pivoting pin (52), a toy head (53) and a connecting lever (54).

Figure 4:
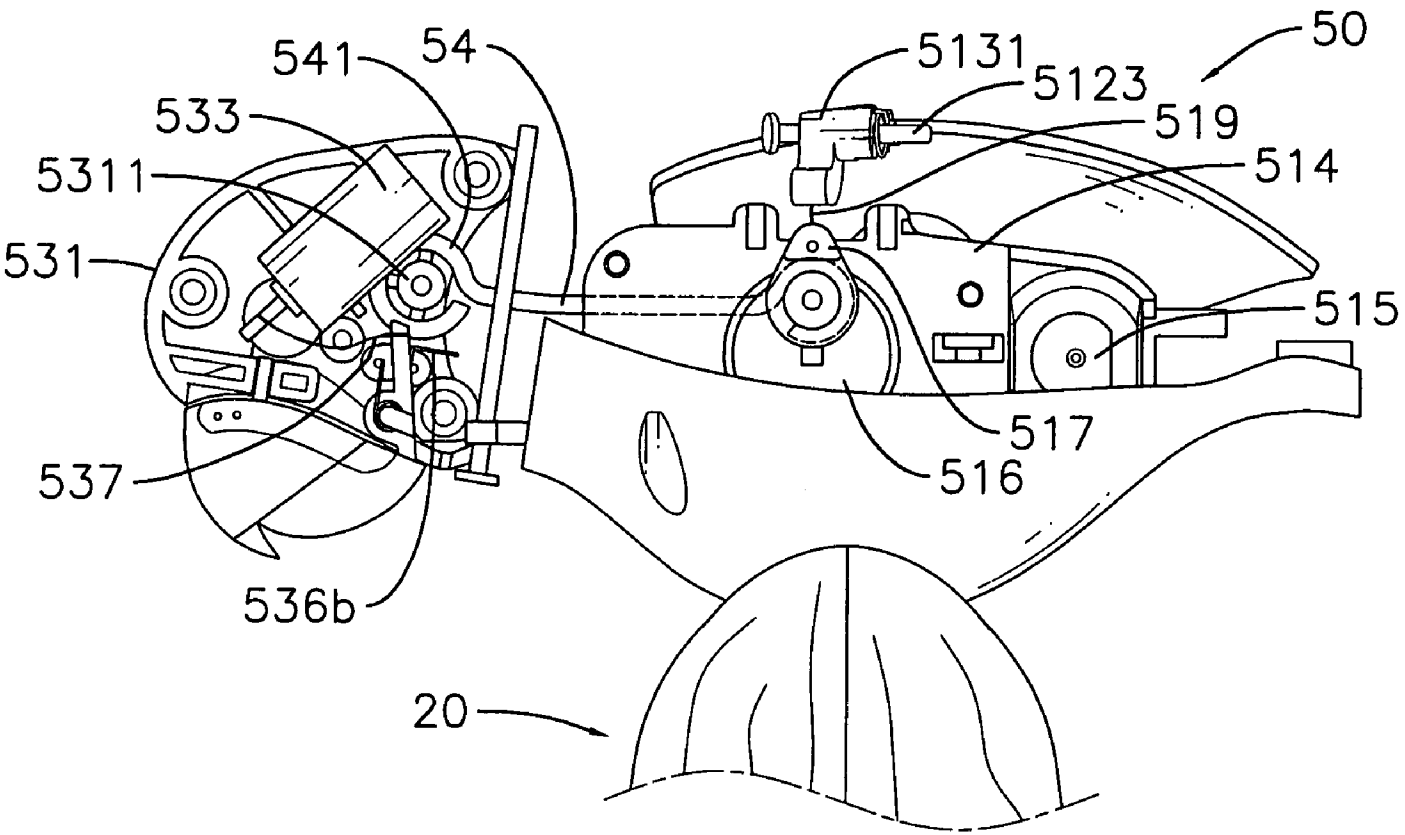
FIG. 4 is an enlarged side view of the robotic toy in FIG. 1.

With reference to FIGS. 1, 3 and 4, the toy body (51) is mounted on the branch segment (48) and has a body casing assembly, a body transmission device, two wing assemblies and two wing-connecting cords (519).

The body casing assembly is mounted securely on the branch segment (48) and has a bottom casing (511), a top casing (512), and an open front. The bottom casing (511) is mounted securely on the branch segment (48) and has a top edge and an inner surface.

With reference to FIG. 5, the top casing (512) is mounted on the top edge of the bottom casing (511) and has an inner surface, an outer surface, two through holes (5121), two pairs of mounting members (5122) and two pins (5123). The through holes (5121) are defined through the top casing (512) and are opposite to each other. The pairs of the mounting members (5122) are formed on the outer surface of top casing (512) and are opposite to each other, and correspond to the through hole (5121) of the top casing (512). The mounting members (5122) are located adjacent to the corresponding through hole (5121) of the top casing (512) and arranged at intervals. Each mounting member (5122) has a mounting hole. The mounting holes of the mounting members (5122) in the same pair are aligned with each other. The pins (5123) correspond to the pairs of the mounting members (5122) and each pin (5123) extends through the mounting holes of the mounting members (5122) in the corresponding pair.

The body transmission device is mounted inside the body casing assembly and has a device box (514), a body motor (515), two side wheels (516) and two connectors (517). The device box (514) is mounted on the inner surface of the body casing (511) and has two opposite sides. The body motor (515) is mounted into the device box (514) and has a spindle rotatably mounted on the body motor (515). The side wheels (516) are mounted rotatably and respectively on the opposite sides of the device box (514) and rotate in response to the body motor (515). Each side wheel (516) has an outer surface opposite to the device box (514) and a side post (5161) eccentrically formed on the outer surface of the side wheel. The connectors (517) are mounted rotatably and respectively on the side posts (5161) of the side wheels (516).

The wing assemblies are mounted rotatably on the outer surface of the top casing (512) and correspond to the through holes (5121), the pins (5123) and the pairs of the mounting members (5122) on the top casing (512). Each wing assembly has a wing (513), a mounting block (5131) and a biasing member (5132). The wing (513) is mounted rotatably on the corresponding pin of the top casing (512) above the corresponding through hole (5121) and has an outer surface and an inside edge. The inside edges of the wings (513) face each other. The mounting block (5131) is formed on the inside edge of the wing, is mounted rotatably on the corresponding pin (5123) between the mounting members (5122) in the corresponding pair, extends through the corresponding through hole (5121) of the top casing (512) and has a distal end. The biasing member (5132) is made of elastic material, is mounted on the corresponding pin and has an inside stationary section and an outside biasing section **(5132*b*). The inside stationary section is formed on the biasing member (5132) and mounted securely on the top casing (512). The outside biasing section (5132*b*) is opposite to the inside stationary section and biases the outer surface of the wing (513) to abut the outer surface of the top casing (512)**.

The wing-connecting cords (519) correspond to the connectors (517) of the body transmission device and the mounting blocks (5131) of the wings (513) and are attached respectively between the corresponding connector (517) and the mounting block (5131).

The head-pivoting pin (52) is mounted transversely on the open front of the body casing assembly.

The toy head (53) is mounted pivotally on the head-pivoting pin (52) and has a head casing assembly, a head motor (533), an upper beak (534), a lower beak (535), a biasing member (536) and a beak-connecting cord (537).

The head casing assembly is mounted pivotally on the head-pivoting pin (52) and has a left casing (531) and a right casing (532), a connecting post (5311), an open back and a bottom. The right casing (532) is mounted pivotally on the head-pivoting pin (52) and has an inner surface. The left casing (531) is mounted to the right casing (532) and has an inner surface. The connecting post is formed on the inner surface of the right or left casing (532, 531). In the embodiment of the present invention, the connecting post is formed on the inner surface of the left casing (531). The open back and bottom are defined with the combination of the left and right casings (531, 532) and the open back is mounted pivotally on the head-pivoting pin (52).

The head motor (533) is mounted inside the head casing assembly and has a front end and a spindle mounted rotatably on the front end of the head motor (533).

The upper beak (534) is mounted on the bottom of the head casing assembly. The lower beak (535) is mounted pivotally through the bottom of the head casing assembly and has a connecting tab (5351) formed on the lower beak (535) and inside the head casing assembly.

The biasing member (536) is made of elastic material, is mounted on connecting tab (5351) of the lower beak (535) and has a stationary section and a biasing section (536*b*). The stationary section is mounted securely inside the head casing assembly. The biasing section (536*b*) is opposite to the stationary section and is mounted securely through the connecting tab (5351) to bias the lower beak (535) to abut the upper beak (534). The beak-connecting cord (537) is attached between the spindle of the head motor (533) and the connecting tab (5351) of the lower beak (535).

The connecting lever (54) extends through the open front of the body casing assembly and the open back of the head casing assembly, and is mounted between one of the side wheels (516) on the device box (514) and the connecting post (5311) in the head casing assembly. The connecting lever (54) has a front end, a back end, a front hook (541) and a back hook (542). The back hook (542) is formed at the back end and is mounted rotatably around the side post (5161) of the side wheel (516) that corresponds to the connecting post (5311). The front hook (541) is formed at the front end and is mounted rotatably around the connecting post (5311) in the left or right casing (532).

The control device is mounted inside the first casing assembly, is connected electrically to the pedestal (10), the first transmission device (30), the mounting shaft assembly (40), the body transmission device, and the head motor (533), and has multiple printed circuit boards (PCBs) (71, 72, 73). The PCBs (71, 72, 73) that are mounted inside the first casing assembly and are connected electrically to the speaker (12), the transmission motor (32), the bushings (46), the body motor (515) and the head motor (533).

To provide the rotating toy assembly (50) with power, a first set of multiple electric wires is connected between the bushings (46) and the toy assembly (50), and a second set of multiple electric wires is connected between the bushing and the control device. The electric wires of the first set extend through the first wire grooves (431) in the driving sleeve (43) and the second wire grooves (452) in the connecting sleeve (45) and are connected to the inner surface of the bushings (46), the body motor (515) and the head motor (533) in the toy assembly (50). The electric wires of the second set are connected to the PCB (73) and contact the outer surface of the bushing (46). When the robotic toy operates with electrical power, the electric power passes through the electric wires of the second set, the bushings (46) and the electric wires of the first set and is supplied into the toy assembly (50).

The PCBs (71, 72, 73) have an audio element (78) to transmit audio signals to the speaker (12). The PCBs (71, 72, 73) control all or some of the speaker (12), the transmission motor (32), the body motor (515) and the head motor (533) to operate simultaneously.

With reference to FIGS. 2, 3, 6, 7 and 8, the robotic toy in accordance with the present invention operates with an external electrical supply, such as batteries mounted in the battery container (11). The transmission motor (32) operates and rotates the shaft (33) by belt means or gears means. The driving gear (34) rotates with the shaft (33) and drives the driven gear (42) to rotate the mounting shaft assembly (40). The rotating driven gear (42) rotates the driving sleeve (43), the connecting sleeve (45) and branch segment (48) so that the toy assembly secured on the branch segment (48) pivots on the mounting shaft assembly (40).

With further reference to FIG. 4, the body motor (515) in the toy body (51) of the toy assembly (50) operates and rotates the side wheels (516) by belt means or gears means. The rotating side wheels (516) cause the side post (5161) to move along a circular path and to respectively pull the wing-connecting cords (519) intermittently. The mounting blocks (5131) are pulled intermittently by the wing-connecting cords (519) and cause the wings (513) to flap against elasticity of the biasing members (5132) in the toy body (51). Furthermore, the connecting lever (54) connected to the side wheel (516) is pulled back or pushed forth by the rotating side wheel (516) to turn the toy head (53) left and right.

The head motor (533) in the toy head (53) operates to rotate the spindle on the head motor (533) and causes the beak-connecting cord to wrap around the spindle. The wrapped beak-connecting cord (537) pulls the connecting tab (5351) of the lower beak (535) to pivot down against the elasticity of the biasing member (536) in the toy head (53) and makes the mouth of the toy head (53) look like it is opening and closing.

With the control of the control device, the toy assembly can rotate on the mounting shaft assembly (40), flap the wings (513), shake the toy head (53) and open the lower beak (535) asynchronously or synchronously. In addition, the speaker (12) produces music or bird song to coordinate with the actions of the toy assembly. The robotic toy in accordance with the present invention performs in a natural and charming manner.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A robotic toy comprising:

a pedestal having a top;

a bottom; and a battery container formed on the pedestal and having multiple battery sockets defined into the bottom of the pedestal;

a first casing assembly mounted on the top of the pedestal and having a branch portion having a left open end;

a transmission device mounted in the first casing assembly and having a hollow device body mounted inside the first casing assembly and having a left side and a right side;

a transmission motor embedded into the right side of the device body and having a left end, a right end and a spindle rotatably mounted on the left end of the transmission motor through the left side of the device body;

a shaft mounted through the left side of the device body, rotating in response to the transmission motor and having an outside end; and a driving gear securely mounted-on the outside end of the shaft;

a mounting shaft assembly mounted inside the first casing assembly and having a mounting shaft mounted securely inside the first casing assembly, and extending through the left open end of the branch portion of the first casing assembly and having a left end, a non-circular cross-section and an axis;

a driven gear mounted rotatably around the mounting shaft, engaging with the driving gear and having a left side and a central tunnel defined through the driven gear and allowing the mounting shaft to extend through the tunnel;

a driving sleeve mounted securely on the left side of the driven gear and having an outer surface;

a left open end;

multiple first wire grooves defined on the outer surface of the driving sleeve along the axis of the mounting shaft and arranged at intervals;

a central hole defined through the driving sleeve and allowing the mounting shaft to extend through the central hole;

a side tab formed transversely on the outer surface of the driving sleeve; and at least one recess defined on the left open end of the driving sleeve;

a connecting sleeve mounted on the left open end of the driving sleeve around a connecting cylinder and having an outer surface;

a central bore defined through the connecting sleeve, allowing the mounting shaft to pass through the central bore;

a right open end;

at least one protrusion formed on the right open end of the connecting sleeve and corresponding to the at least one recess of the driving sleeve;

multiple second wire grooves defined on the outer surface of the connecting sleeve and along the axis of the mounting shaft, arranged at intervals and corresponding to the wire grooves on the driving sleeve; and multiple mounting tabs formed on the outer surface adjacent to the left open end of the connecting sleeve and located respectively between the adjacent wire grooves on the connecting sleeve;

four bushings made of metal and mounted on the outer surfaces of the driving sleeve and connecting sleeve;

three isolating washers made of isolating material, mounted rotatably on the surfaces of the driving sleeve and connecting sleeve and located respectively between adjacent bushings;

a branch segment mounted securely on the left open end of the connecting sleeve and having a central orifice defined through the branch segment and allowing the mounting shaft to extend through the central orifice;

an inner surface;

a right open end;

a left open end; and multiple transverse recesses defined on the inner surface adjacent to the right open end of the branch segment and corresponding to the mounting tabs of the connecting sleeve; and a tip mounted securely on the left end of the mounting shaft and adjacent to the left open end of the branch segment; and a toy assembly mounted rotatably on the mounting shaft assembly and having:

a toy body mounted on the branch segment and having a body casing assembly mounted securely on the branch segment and having an open front;

a body transmission device mounted inside the body casing assembly;

two wing assemblies mounted rotatably on the body casing assembly and flapping in response to the body transmission device;

a toy head mounted on the open front of the body casing assembly and having:

a head casing assembly mounted on the open front of the body casing assembly and having a bottom;

an upper beak mounted on the bottom of the head casing assembly; and a lower beak mounted through the bottom of the head casing assembly.

2. The robotic toy assembly as claimed in claim 1, wherein:

the body casing assembly of the toy body further has a bottom casing mounted securely on the branch segment and having a top edge and an inner surface;

a top casing mounted on the top edge of the bottom casing and having an inner surface;

an outer surface;

two through holes defined through the top casing and opposite to each other;

two pairs of two mounting members, formed on the outer surface of top casing opposite to each other and corresponding to the through hole of the top casing, wherein the mounting members of each pair are located adjacent to the corresponding through hole of the top casing and are arranged at an interval, and each mounting member has a through hole defined through the mounting member, wherein through holes of the mounting members in the same pair are aligned with each other; and two pins corresponding to the pairs of the mounting members and each pin extending through the mounting holes of the mounting members in the corresponding pair;

the body transmission device has a device box mounted in the body casing assembly and having two opposite sides;

a body motor mounted into the device box and having a spindle rotatably mounted on the body motor;

two side wheels mounted rotatably and respectively on the opposite sides of the device box and rotating in response to the body motor, and each side wheel having an outer surface opposite to the device box; and a side post eccentrically formed on the outer surface of the side wheel; and two connectors mounted rotatably and respectively on the side posts of the side wheels; and the wing assemblies is mounted rotatably on the outer surface of the top casing and corresponds to the through holes, the pins and the pairs of the mounting members on the top casing, and each wing assembly has a wing mounted rotatably on the corresponding pin of the top casing above the corresponding through hole and having an outer surface and an inside edge, wherein the inside edges of the wings face each other;

a mounting block formed on the inside edge of the wing, rotatably mounted on the corresponding pin between the mounting member in the corresponding pair, extending through the corresponding through hole of the top casing and having a distal end; and a biasing member made of elastic material, mounted on a corresponding one of the pins and having an inside stationary section formed on the bias member and mounted securely on the top casing; and an outside biasing section opposite to the inside stationary section and biasing the outer surface of the wing to abut the outer surface of the top casing; and the toy assembly further has two wing-connecting cords corresponding to a plurality of connectors of the body transmission device and the mounting blocks of the wings and respectively attached between the corresponding connector and mounting block.

3. The robotic toy as claimed in claim 2, wherein:

the toy assembly further has a head-pivoting pin mounted transversely on the open front of the body casing assembly;

the head casing assembly of the toy head is mounted pivotally on the head-pivoting pin and further has a connecting post formed on an inner surfaces of a left or right casing;

an open back mounted pivotally on the head-pivoting pin; and a connecting lever extending through the open front of the body casing assembly and an open back of the head casing assembly, mounted between one of the side wheels on the device box and the connecting post in the head casing assembly and having a front end;

a back end;

a front hook formed at the front end and rotatably mounted around the connecting post; and a back hook formed at the back end and rotatably mounted around the side post of the side wheel corresponding to the connecting post.

4. The robotic toy as claimed in claimed 3, wherein:

the pedestal further has a speaker mounted on the top of the pedestal; and a control device mounted inside the first casing assembly, connected electrically to the pedestal, the first transmission device, the mounting shaft assembly and the body transmission device, and having multiple printed circuit boards (PCBs) mounted inside the first casing assembly, connected electrically to the speaker, the transmission motor, the bushings and the body motor, having an audio element to transmit audio signals to the speaker and adapted for controlling all or some of the speaker, the transmission motor and the body motor to operate simultaneously.

5. The robotic toy as claimed in claim 1, wherein:

the toy head further has a head motor mounted inside the head casing assembly and having a front end and a spindle mounted rotatably on the front end of the head motor;

the lower beak is mounted pivotally through the bottom of the head casing assembly and has a connecting tab formed on the lower beak and inside the head casing assembly;

a biasing member is made of elastic material, is mounted on the connecting tab of the lower beak and has a stationary section mounted securely through the connecting tab inside the head casing assembly; and a biasing section opposite to the stationary section and mounted securely through the connecting tab to bias the lower beak to abut the upper beak; and a beak-connecting cord is attached between the spindle of the head motor and the connecting tab of the lower beak.

6. The robotic toy as claimed in claimed 5, wherein:

the pedestal further has a speaker mounted on the top of the pedestal; and a control device mounted inside the first casing assembly, connected electrically to the pedestal, the first transmission device, the mounting shaft assembly and head motor, and having multiple printed circuit boards (PCBs) mounted inside the first casing assembly, connected electrically to the speaker, the transmission motor, the bushings and the head motor, having an audio element to transmit audio signals to the speaker and adapted for controlling all or some of the speaker, the transmission motor and the head motor to operate simultaneously.

* * * * *